United States Patent [19]

Diehl

[11] Patent Number: 4,571,232

[45] Date of Patent: Feb. 18, 1986

[54] FOLDING CARTON WITH PREFITTED INTERIOR WRAPPING

[76] Inventor: Philip A. Diehl, 482 N. Lexington Dr., Lake Forest, Ill. 60045

[21] Appl. No.: 595,649

[22] Filed: Apr. 2, 1984

[51] Int. Cl.[4] ..... B31B 1/14; B31B 7/14; B31B 7/26

[52] U.S. Cl. ..... 493/96; 53/449; 53/458; 206/299; 220/463; 229/41 B

[58] Field of Search ..... 220/463, 416, 418, 441, 220/443, 462; 206/299; 53/458, 449, 457; 493/96, 94, 98, 100, 93, 95, 97; 229/41 B, 31 R, 41 R

[56] References Cited

U.S. PATENT DOCUMENTS

| | | | |
|---|---|---|---|
| 1,311,047 | 7/1919 | Cole | 229/31 R |
| 1,548,494 | 8/1925 | Van Wormer | 229/31 R |
| 1,601,625 | 9/1926 | Hruby | 220/463 |
| 1,656,307 | 1/1928 | Walter | 229/41 B |
| 1,667,482 | 4/1928 | Lee | 206/299 X |
| 2,141,438 | 12/1938 | Hirsch | 229/41 B |
| 2,832,270 | 4/1958 | Pierce, Jr. et al. | 493/96 X |
| 2,936,101 | 5/1960 | Eimer | 220/463 |
| 3,344,971 | 10/1967 | Walke | 220/463 |
| 3,424,595 | 1/1969 | Tolman | 493/93 X |
| 4,099,614 | 7/1978 | Heissenberger | 206/299 |
| 4,177,936 | 12/1979 | Ford, Jr. et al. | 220/441 |
| 4,441,626 | 4/1984 | Hall | 220/443 |

*Primary Examiner*—Allan N. Shoap
*Attorney, Agent, or Firm*—Lee, Smith & Zickert

[57] ABSTRACT

A foldable carton having a prefitted interior wrapping liner for wrapping articles. The carton has foldable side walls which secure the wrapping liner in a flattened arrangement. The interior liner is neatly folded and secured by the collapsed side walls so that upon erecting the side walls the properly sized wrapping liner is exposed for immediate use in wrapping an article inside the carton.

4 Claims, 3 Drawing Figures

FOLDING CARTON WITH PREFITTED INTERIOR WRAPPING

BACKGROUND AND SUMMARY OF THE INVENTION

The present invention is directed to merchandise packaging which requires a sales clerk to wrap items selected by the customer and thereafter enclose them in a carton in a neat manner.

In the past, sales clerks have been obligated to wrap a wide variety of goods and place them in folding cartons in an orderly fashion so that the customer can leave the store with a nicely wrapped package.

Usually, a sales counter is provided with folding cartons in a wide variety of sizes. This permits the sales clerk to select an appropriately sized carton for the goods. The clerk is also required to select and fold an appropriately sized tissue wrapping which will neatly enclose the goods and accommodate them in the carton in a visually attractive appearance. This procedure requires a certain amount of skill on the part of the clerk to expeditiously prepare the package for the waiting customer.

Oftentimes, the sales clerk is provided with a stack of single sized tissue sheets. Thus, the wrapping chore becomes even more difficult since the single size must be folded in arrangemnts to fit the variously sized cartons as well as the differently shaped goods.

During busy periods, these inefficient procedures have led to poorly wrapped packages due to the sales person rushing to complete numerous purchases made one right after another. Selecting the carton and arranging a properly folded wrapping takes time and can cause long lines to be formed at the sales counter. The goodwill of the business may be harmed by making customers wait a long period of time in line only to receive a poorly wrapped package. This is particularly acute when the purchase is intended as a gift. A more efficient way to complete sales would benefit both the customer and the store owner.

It is accordingly a primary object of the invention to provide a foldable carton in which a prefitted interior wrapping is secured ready for immediate use by the sales clerk.

It is an important object of the invention to provide a folding carton with a prefitted interior wrapping that is centrally adhered to the bottom of the carton and has opposite flaps for overlying the goods to be packaged.

It is an allied goal of the invention to eliminate the need for a sales clerk to separately select a tissue wrap and a carton.

It is accordingly a concomitant goal of the invention to provide a folding carton with a prefitted interior wrapping that allows sales clerks to uniformly prepare a neat and tidy package for merchandise.

It is another object of the invention to simply require the sales clerk to choose a box size sufficient to hold the goods and eliminate the need for any further selection of interior wrapping for the goods.

It is yet another goal of the invention to provide a method for manufacturing a folding carton having a prefitted interior wrapping wherein the wrapping is adhesively tacked to a carton blank, the bank is die-cut, and thereafter the carton and wrapping are creased and folded to form a foldable receptacle.

It is a related objection of the invention to provide a method for making a folding carton with a prefitted interior wrapping which arranges a wrapping liner in a substantially flat folded condition until use.

It is still another object of the invention to provide a method for making a folding carton with a prefitted interior lining that is capable of wrapping an article of merchandise on all sides upon assembly of the carton.

The invention may be summarized as comprising a foldable bottom half of a carton or box which includes a prefitted interior wrapping capable of being unfolded when the carton is erected so that an article of merchandise may be wrapped in a neat and uniform manner. A portion of the interior wrapping is adhesively tacked to the interior bottom surface of the carton. The folding carton has two pairs of opposing side walls, wherein a first opposing pair have diagonal bend lines to permit the second pair to foid over the first. The interior wrapping is of a sufficient size in one direction to provide a box-interior lining across the bottom and for the full height of one pair of side walls. In the transverse direction the wrapping has a sufficient length to provide two side flaps which can unfold outwardly of the carton upon erection of the sidewalls. The flaps are sufficiently large to fold over goods placed in the box. Intermediate the two flaps a central portion of the wrapping comprises the bottom lining of the box, which is the portion that is adhesively tacked to the carton.

The invention may be further summarized as comprising a method for manufacturing a foldable carton having a prefitted interior wrapping. The method includes adhesively tacking a wrapping material to a blank for the carton. Thereafter, the blank is die cut to provide foldable side walls. The wrapping and die cut blank are creased and folded, and the side walls are connected to form the four corners of the box. The constructed carton is then capable of being stored in a collapsed condition with the neatly folded wrapping secured by the folded side walls ready for use.

BRIEF DESCRIPTION OF THE DRAWINGS

The invention is described in greater detail in the following description of the preferred embodiment, taken in conjunction with the drawings, in which.

DESCRIPTION OF THE PREFERRED EMBODIMENT

With reference to the figures it will be understood that a folding carton 10 includes a wrapping W secured interiorly thereof. In the disclosed embodiment the carton 10 has a generally rectangular configuration comprising opposing shorter side walls 11, 12 and opposing long side walls 13, 14. Walls 11–14 may of course be of equal length whereby carton 10 will be square in plan. However, the invention is not limited to rectangular cartons and may be practiced with a variety of shapes. Carton 10 includes a planar bottom 15 which is integrally formed with the side walls. The side walls are pivotally connected around the border edge of the bottom.

Figure 1:
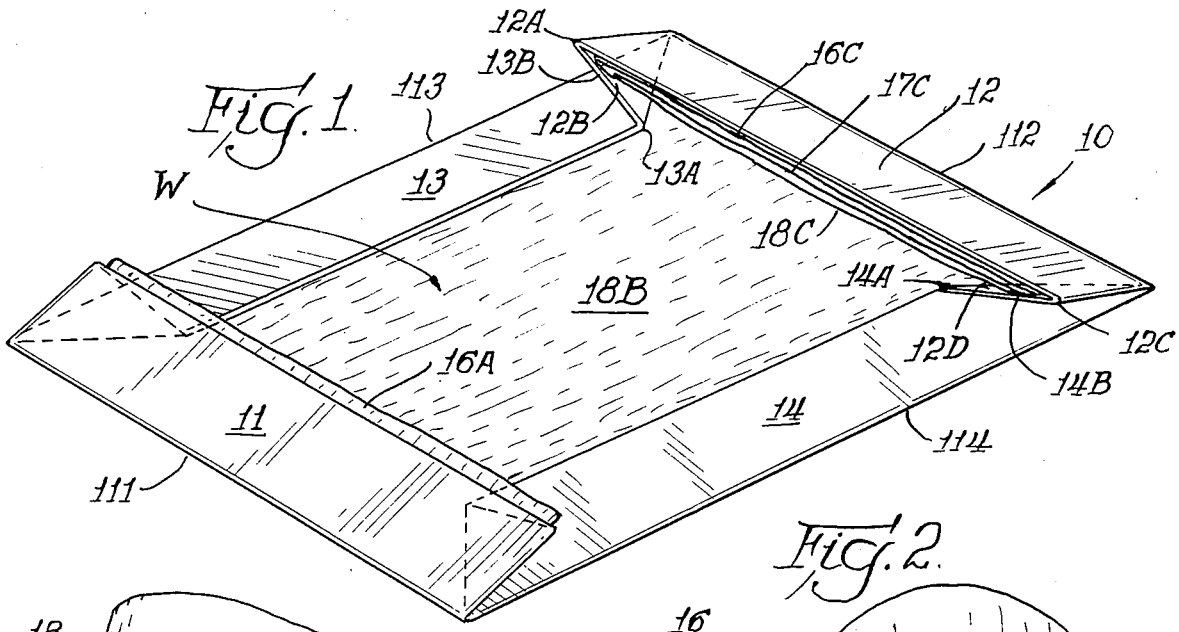
FIG. 1 is a perspective view of a folding carton having a prefitted interior wrapping in accordance with the invention wherein the carton and wrapping are in a substantially flattened condition.

The foldability of carton 10 is provided in a generally conventional manner wherein the shorter side walls 11 and 12 maintain a generally rectangular formation whether folded or standing upright. Long side walls 13 and 14 include diagonal bend lines at opposite ends and fold under walls 11 and 12 into a generally trapezoidal shape. With reference to FIG. 1, it will be seen that side wall 12 terminates at opposite corners 12A and 12C. Connecting flaps 12B and 12D extend freely from corners 12A and 12C, respectively, and are secured at the interior surfaces of the longer side walls 13 and 14. During manufacturing, flaps 12B and 12D are, in preferred form, adhesively secured to walls 13 and 14. Also, flaps 12B and 12D, and long walls 13 and 14, are diagonally creased at lines 13A and 14A whereby to provide hinged triangular end sections 13B and 14B.

The arrangement shown for the connections of wall 12 to walls 13 and 14, is substantially identical to the connection of wall 1 at the other end of the carton.

In the folded condition, the long side walls 13 and 14 assume the generally trapezoidal configuration caused by the folding of triangular end sections 13B and 14B thereover. To unfold carton 10 the side walls are simply pivoted to the vertical position which moves triangular sections 13B and 14B into planar alignment with walls 13 and 14 and at right angles to shorter side walls 11 and 12.

Upon unfolding the side walls, the prior art required the sales clerk to separately select the wrapping and fold it inside the carton in a proper arrangement for ultimately wrapping the article. The present invention achieves the significant benefit of providing an interiorly fitted wrap W which is secured within carton 10 and is complementarily foldable with the side walls.

In preferred form, a blank is cut from a roll of cardboard stock and wrap W is adhesively tacked to the carton blank at the intended location of bottom 15. The blank is then die cut with the wrap W held on bottom 15. The assembly is then moved to a creasing and folding machine which forms the side walls and arranges wrap W within carton 10, as will be hereinafter explained. During folding, the adhesive securement of the triangular sections of the long side walls to the connecting flaps of the shorter side walls takes place.

In the disclosed embodiment, wrap W comprises a single sheet of tissue paper material commonly used in the merchandising industry. In preferred form, the tissue sheet has a length and width both greater than the corresponding length and width of the carton bottom 15.

When the carton blank has been die-cut, the blank and wrap W are then creased. The blank is creased along lines 111, 112, 113 and 114 to define retangular bottom 15 and side walls 11–14 which, due to the creasing, are pivotally connected along the border of the bottom 15. Diagonal crease lines 13A and 14A are also made at the ends of the long side walls 13 and 14, and at the connecting end flaps of the shorter side walls 11 and 12. Wrap W is also creased generally parallel, and adjacent, to lines 113 and 114. Thereby, three parallel wrap sections 16, 17 and 18 are formed with sections 17 and 18 comprising side flaps at opposite sides of section 16. These sections have substantially the same length taken in a direction parallel to crease lines 113 and 114.

In the preferred embodiment, sections 16, 17 and 18 are all provided in about the same width as bottom 15. Section 17 is then folded onto 16, and 18 is folded onto 17 to create a triple thickness overlapping arrangement. Also, since in the preferred form wrap W is longer than bottom 15, two transverse creases are then made on the folded wrap generally parallel, and adjacent, to lines 111 and 112. Each wrap section is thereby provided with A, B and C portions, as shown in the figures. The B portions are overlappingly folded across bottom 15 and the overlapping A and C portions form end flaps of wrap W and extend from the B portions to overlie shorter side walls 11 and 12, respectively.

Portion 16B thereby comprises a central portion of wrap W, which has a four-sided peripheral crease generally following the four crease lines 111–114. The surrounding portions 16A, 16C, 17A, 17B, 17C, 18A, 18B and 18C of wrap W may thus be defined as extending from the peripheral crease in a freely foldable manner. In one alternative embodiment, wrap W may be provided in a shorter length and include only the B portions of sections 16, 17 and 18. Transverse creases at lines 111 and 112 will not be made. Thereby, only portions 17B and 18B will extend from the two peripheral crease lines 113 and 114 in a freely foldable manner.

Either the carton blank or wrap W may be creased first depending upon the choice of the manufacturer.

The side walls are then folded about 90° to stand normally with respect to bottom 15 and create four right angle corners of carton 10. Adhesive securement of the connecting flaps of side walls 11 and 12 to the interior surfaces of side walls 13 and 14, is then made, whereby double-thickness triangular end sections 13B and 14B are formed. At this juncture, the A and C portions of sections 16, 17 and 18 are disposed upright and adjacent side walls 11 and 12.

Subsequently, the four side walls 11–14 are folded toward bottom 15. The diagonal bend lines 13A and 14A allow the triangular sections 13B and 14B to fold onto side walls 13 and 14, whereby the side walls 13 and 14 collapse to the trapezoidal shape, as best viewed in FIG. 1.

As the folding occurs, the A portions of wrap W are clamped at opposite ends between side wall 11 and the triangular sections of side walls 13 and 14 at one end of carton 10. In the same manner, the C portions are similarly clamped at the opposite ends of carton 10 between side wall 12 and the other triangular sections of side walls 13 and 14. Intermediate the triangular sections, side walls 11 and 12 retain the A and C sections in a folded relationship overlying marginal edges of the B portions adjacent crease lines 111 and 112, respectively. Marginal edges of the B portions adjacent crease lines 113 and 114 are held by the collapsed walls 13 and 14. As a result, the assembled carton 10 is collapsed for storage with wrap W snugly secured by the side walls in a neat folded arrangement. This is the flat folded configuration best viewed in FIG. 1. Since the tissue wrap W is significantly thinner than carton 10, a plurality of cartons 10 with interfitted wrapping W may be stacked at a sales counter in substantially the same manner as the present storage of conventional folding cartons. The great benefit of the invention is that the correctly size wrap is already inside the carton ready for use by the sales clerk.

Figure 2:
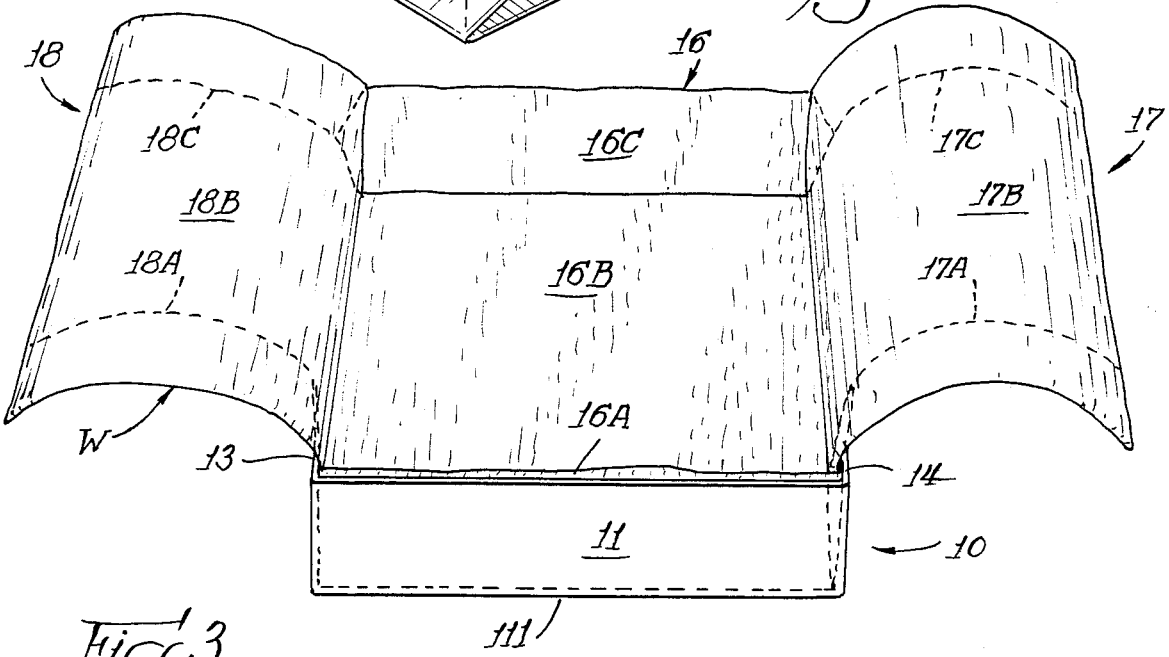
FIG. 2 is another perspective view of the carton shown in FIG. 1 but having the wrapping unfolded ready for receipt of an article of merchandise to be wrapped; and, FIG. 3 is a transverse cross-sectional view of the carton and wrapping illustrated in FIGS. 1 and 2 showing the side walls fully erected and the interior wrapping in the arrangement just prior to being unfolded as shown in FIG. 2.

FIG. 2 shows carton 10 erected and sections 17 and 18 unfolded for receipt of the merchandise. The 17A, 18A, 17C and 18C portions which had been in the threeply arrangement with the 16A and 16C portions, respectively, as shown in FIG. 1, unfold to the undersides of portions 17B and 18B, as shown in the phantom lines. The 16A and 16C end portions remain adjacent side walls 11 and 12. As a result, wrapping W includes two-ply portions on side flaps 17 and 18 for ease of handling and additional stiffness. This double thickness, created by the underfolded A and C portions of sections 17 and 18 also serves to prevent tearing of wrap W during wrapping procedures.

An additional feature of the invention is the complete enveloping of an article of merchandise. As side flap 17 is folded on top of the goods, and thereafter overlapped by side flap 18, the goods are completely covered. The goods are laterally surrounded by wrap W along side walls 11–14, and rest atop central portion 16B at bottom 15.

Figure 3:
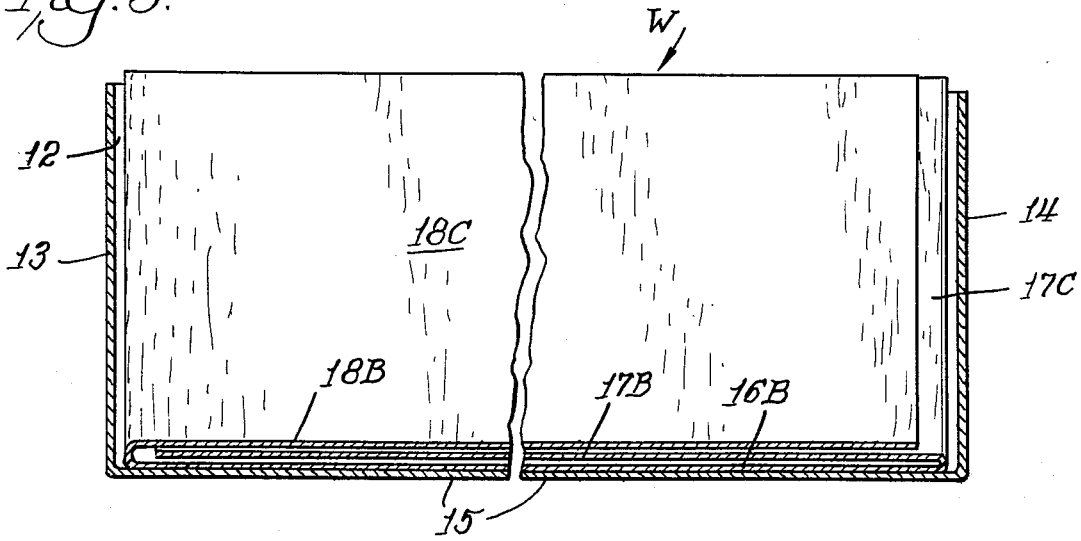

FIG. 3 shows carton 10 with the side walls in the erected upright condition just prior to outwardly unfolding flaps 17 and 18. Portions 16B, 17B and 18B are proportioned to neatly overlap as shown. End portions 16C, 17C and 18C preferably extend for a distance greater than the height of the side wall 12. A corresponding arrangement is provided at wall 11 for end portions 16A, 17A and 18A, as would be understood. By having this slightly greater height, a complete wrapping at the ends of the merchandise is assured. In the illustrated embodiment, section 18 has a width slightly less than section 17. By being slightly less in this transverse dimension, the unfolding of flap 18 is made easier by providing a clearly defined edge for the sales clerk to see and grasp. These are preferred features of the invention but are not considered critical to the practice thereof.

The adhesive tacking of wrapping W to carton 10 is provided at the interface between central portion 16B and bottom 15. Since the function of the adhesive tacking is simply to maintain wrapping W in place, only one or two spots of adhesive contact are required. For ease of manufacture, it is envisioned that the leading edge of bottom 15 receive a bead of adhesive material after the cardboard blank is unrolled and cut from a roll of cardboard stock. One skilled in the art would find numerous alternative procedures for applying adhesive suitable for use in practicing the invention. For example, dots of adhesive at the four corners of bottom 15 could be used. Due to the light weight and flimsy nature of tissue paper, only a small amount of adhesive or cement is required to tack wrap W into place. The folding steps maintain wrap W in a snug interfitted arrangement within carton 10 in addition to the tacking securement provided by the adhesive.

While the preferred embodiment incorporates a single layer of tissue wrap W, a plurality of layers is also envisioned. Such additional layers might be required when heavy or bulky items are to be contained in carton 10.

It will be appreciated that carton 10 with interfitted wrap W is suitable for use with a correspondingly shaped lid of a conventional design. Such lid covers are usually foldable for storage in a similar manner to the folding side walls of carton 10.

I claim:

1. A method for making a flattened foldable carton with a prefitted interior wrapping liner, the method comprising the steps of:

die-cutting a flat blank for the carton to a predetermined length and width and to create side wall corner connections;

tacking a central portion of a sheet of wrapping material to the blank at a location thereon selected to be the bottom of the carton;

creasing the blank and sheet of wrapping material to create side wall fold lines, a four-sided hinged border between the carton bottom and side walls, wherein said wrapping material has a border-corresponding peripheral crease around the central portion of the wrapping material;

folding the creased blank to erect the side walls to be normal to said carton bottom wherein said wrapping material has untacked remaining portions of the sheet being folded at said peripheral crease to create a pair of overlapping side flaps in one direction and folded end flaps in the transverse direction capable of being folded to overlie said overlapping side flaps in a combined flattened arrangement over said carton bottom;

securing the die cut corners of the side walls to form a continuously connected side wall around the carton bottom; and, folding the carton side walls at said fold lines toward the carton bottom to overlie side wall-adjacent margins of the folded wrapping material and thereby securing the wrapping material in a folded arrangement between the side walls and carton bottom;

said carton and folded wrapping material thereby being provided in a generally flattened arrangement.

2. A method as in claim 1 wherein the step of tacking the sheet of wrapping material comprises placing adhesive material on the carton blank and adhering the sheet of wrapping material thereat.

3. The method according to claim 1 wherein said tacking step precedes said die-cutting step, and said die-cutting step includes simultaneously cutting said wrapping material and blank to said predetermined length.

4. The method according to claim 1 wherein said method includes a step prior to said tacking step comprising cutting said wrapping material to a predetermined length.

* * * * *

UNITED STATES PATENT AND TRADEMARK OFFICE

CERTIFICATE OF CORRECTION

PATENT NO. : 4,571,232

DATED : February 18, 1986

INVENTOR(S) : Philip A. Diehl

It is certified that error appears in the above-identified patent and that said Letters Patent are hereby corrected as shown below:

In Col. 1, line 28, please delete the misspelled word "arrangemnts" and substitute therefor -- arrangements --.

In Col. 3, line 23, please delete the number "1" and substitute therefor the number "11".

Signed and Sealed this

*Fifth* Day of *August 1986*

[SEAL]

*Attest:*

DONALD J. QUIGG

*Attesting Officer*

*Commissioner of Patents and Trademarks*